US009441479B2

(12) United States Patent
Froelich et al.

(10) Patent No.: US 9,441,479 B2
(45) Date of Patent: Sep. 13, 2016

(54) MECHANICAL FILTER FOR ACOUSTIC TELEMETRY REPEATER

(71) Applicant: Schlumberger Technology Corporation, Sugar Land, TX (US)

(72) Inventors: Benoit Froelich, Marly-le-Roi (FR); Stephane Vannuffelen, Meudon (FR); Christophe M. Rayssiguier, Melun (FR)

( * ) Notice: Subject to any disclaimer, the term of this patent is extended or adjusted under 35 U.S.C. 154(b) by 0 days.

(21) Appl. No.: 14/169,477

(22) Filed: Jan. 31, 2014

(65) Prior Publication Data

US 2014/0209313 A1 Jul. 31, 2014

(30) Foreign Application Priority Data

Jan. 31, 2013 (EP) ..... 13153567

(51) Int. Cl.

| | |
|---|---|
| ***E21B 34/04*** | (2006.01) |
| ***E21B 17/01*** | (2006.01) |
| ***E21B 33/035*** | (2006.01) |
| ***E21B 47/16*** | (2006.01) |
| ***E21B 41/00*** | (2006.01) |

(52) U.S. Cl.

CPC ..... *E21B 47/16* (2013.01); *E21B 17/01* (2013.01); *E21B 33/035* (2013.01); *E21B 34/04* (2013.01); *E21B 41/0007* (2013.01)

(58) Field of Classification Search

CPC ..... E21B 17/01; E21B 33/035; E21B 34/04; E21B 41/0007; E21B 47/16

USPC ..... 166/335, 177.1, 250.01

See application file for complete search history.

(56) References Cited

U.S. PATENT DOCUMENTS

| | | | | |
|---|---|---|---|---|
| 4,066,995 | A * | 1/1978 | Matthews | 367/82 |
| 4,378,850 | A * | 4/1983 | Barrington | 166/373 |
| 5,050,132 | A | 9/1991 | Duckworth | |
| 5,056,067 | A | 10/1991 | Drumheller | |
| 5,124,953 | A | 6/1992 | Grosso | |
| 5,128,901 | A | 7/1992 | Drumheller | |

(Continued)

FOREIGN PATENT DOCUMENTS

| | | |
|---|---|---|
| EP | 0636763 | 2/1995 |
| EP | 0550521 | 8/1995 |

(Continued)

OTHER PUBLICATIONS

Extended Search Report for the equivalent EP patent application No. 13153567.6 issued on Sep. 5, 2013.

*Primary Examiner* — James G Sayre
(74) *Attorney, Agent, or Firm* — Cameron R. Sneddon

(57) ABSTRACT

A subsea installation kit is described. The kit is provided with a subsea tree, a plurality of tubing sections, a plurality of acoustic repeaters and a mechanical filter. The subsea tree is configured to be coupled to a subsea well having a wellbore. The tubing sections are configured to be connected together to form a tubing string extending from above the tree into the wellbore. The acoustic repeaters are configured to be attached to the tubing string in a spaced apart manner. One of the acoustic repeaters is a last acoustic repeater configured to be attached to the tubing string within or above the tree. The mechanical filter is configured to be connected into the tubing string and form a part of the tubing string above the last acoustic repeater, the mechanical filter configured to cause an attenuation to acoustic signals propagating in the tubing string above the tree.

20 Claims, 4 Drawing Sheets

(56) References Cited

U.S. PATENT DOCUMENTS

| | | | | |
|---|---|---|---|---|
| 5,128,902 | A | 7/1992 | Spinnler | |
| 5,148,408 | A | 9/1992 | Matthews | |
| 5,222,049 | A | 6/1993 | Drumheller | |
| 5,274,606 | A | 12/1993 | Drumheller et al. | |
| 5,293,937 | A * | 3/1994 | Schultz et al. | 166/250.01 |
| 5,477,505 | A * | 12/1995 | Drumheller | 367/82 |
| 5,568,448 | A | 10/1996 | Tanigushi et al. | |
| 5,675,325 | A | 10/1997 | Taniguchi et al. | |
| 5,703,836 | A | 12/1997 | Drumheller | |
| 5,815,035 | A | 9/1998 | Yamagishi et al. | |
| 5,923,937 | A | 7/1999 | Thompson et al. | |
| 5,941,307 | A | 8/1999 | Tubel | |
| 5,995,449 | A | 11/1999 | Green et al. | |
| 6,137,747 | A | 10/2000 | Shah et al. | |
| 6,147,932 | A | 11/2000 | Drumheller | |
| 6,188,647 | B1 | 2/2001 | Drumheller | |
| 6,192,988 | B1 | 2/2001 | Tubel | |
| 6,272,916 | B1 | 8/2001 | Taniguchi et al. | |
| 6,320,820 | B1 | 11/2001 | Gardner et al. | |
| 6,321,838 | B1 | 11/2001 | Skinner | |
| 6,535,458 | B2 | 3/2003 | Meehan | |
| 6,912,177 | B2 | 6/2005 | Smith | |
| 8,270,251 | B2 | 9/2012 | Drumheller et al. | |
| 2003/0179101 | A1* | 9/2003 | Jenkins | 340/854.4 |
| 2005/0279565 | A1* | 12/2005 | Arian et al. | 181/121 |
| 2006/0000665 | A1* | 1/2006 | Shah et al. | 181/108 |
| 2010/0208552 | A1 | 8/2010 | Camwell et al. | |
| 2013/0284432 | A1* | 10/2013 | MacPhail et al. | 166/250.01 |

FOREIGN PATENT DOCUMENTS

| | | |
|---|---|---|
| EP | 0773345 | 11/1995 |
| EP | 1076245 | 2/2001 |
| EP | 1193368 | 4/2002 |
| EP | 1882811 | 1/2008 |
| GB | 2327957 | 2/1999 |
| WO | 92/06275 | 4/1992 |
| WO | 92/06278 | 4/1992 |
| WO | 96/24751 | 8/1996 |
| WO | 00/77345 | 12/2000 |
| WO | 01/39412 | 5/2001 |
| WO | 02/27139 | 4/2002 |
| WO | 2005/005724 | 1/2005 |
| WO | 2007/095111 | 8/2007 |

* cited by examiner

--Prior Art--

MECHANICAL FILTER FOR ACOUSTIC TELEMETRY REPEATER

BACKGROUND

The retrieval of desired fluids, such as hydrocarbon based fluids, is pursued in subsea environments. Production and transfer of fluids from subsea wells relies on subsea installations, subsea flow lines and other equipment.

Shown in FIG. 1 is a schematic view of a prior art subsea installation 10. The subsea installation 10 comprises a subsea tree 12 formed of a subsea wellhead 14, which may include a Christmas tree, coupled to a subsea well 16 having a wellbore 18. The illustrated subsea tree 12 further comprises a subsea lubricator 20 and a lubricating valve 22 that may be deployed directly above the subsea wellhead 14. Lubricating valve 22 can be used to close the wellbore 18 during certain intervention operations, such as tool change outs. The subsea tree 12 also includes a blowout preventer 24 positioned below the lubricating valve 22 and may comprise one or more cut-and-seal rams 25 able to cut through the interior of the subsea installation 10 and seal off the subsea installation 10 during an emergency disconnect. The subsea tree 12 also may comprise a latch 26, a retaining valve 27 and a second blowout preventer 28 positioned above the blowout preventer 24 and a spanner 34 positioned above the second blowout preventer 28. The subsea installation 10 also includes (1) a riser 36 extending from the second blowout preventer 28 to the surface, (2) a hydraulic pod 38 positioned inside the riser 36 above the spanner 34, and (3) a tubing string 40 positioned inside the riser 36.

One of the more difficult problems associated with the wellbore 18 is to communicate measured data between one or more locations down the wellbore 18 and the surface, or between downhole locations themselves. For example, in the oil and gas industry it is desirable to communicate data generated downhole to the surface during operations such as drilling, perforating, fracturing, and drill stem or well testing; and during production operations such as reservoir evaluation testing, pressure and temperature monitoring. Communication is also desired to transmit intelligence from the surface to downhole tools or instruments to effect, control or modify operations or parameters.

Accurate and reliable downhole communication may be beneficial when complex data comprising a set of measurements or instructions is to be communicated, i.e., when more than a single measurement or a simple trigger signal has to be communicated. For the transmission of complex data it is often desirable to communicate encoded digital signals.

Downhole testing is traditionally performed in a "blind fashion": downhole tools and sensors are deployed in the subsea well 16 at the end of the tubing string 40 for several days or weeks after which they are retrieved at surface. During the downhole testing operations, the sensors may record measurements that will be used for interpretation once retrieved at surface. It is after the tubing string 40 is retrieved that the operators will know whether the data are sufficient and not corrupted. Similarly when operating some of the downhole testing tools from surface, such as tester valves, circulating valves, packers, samplers or perforating charges, the operators do not obtain a direct feedback from the downhole tools.

In this type of downhole testing operations, the operator can greatly benefit from having a two-way communication between surface and downhole. However, it can be difficult to provide such communication using a cable inside the tubing string 40 because the cable would limit the flow diameter and involves complex structures to pass the cable from the inside to the outside of the tubing string 40. A cable inside the tubing string 40 is also an additional complexity in case of emergency disconnect for an offshore platform. Space outside the tubing string 40 is limited and a cable can easily be damaged.

A number of proposals have been made for wireless telemetry systems based on acoustic and/or electromagnetic communications. Examples of various aspects of such wireless telemetry systems can be found in: U.S. Pat. Nos. 5,050,132; 5,056,067; 5,124,953; 5,128,901; 5,128,902; 5,148,408; 5,222,049; 5,274,606; 5,293,937; 5,477,505; 5,568,448; 5,675,325; 5,703,836; 5,815,035; 5,923,937; 5,941,307; 5,995,449; 6,137,747; 6,147,932; 6,188,647; 6,192,988; 6,272,916; 6,320,820; 6,321,838; 6,912,177; EP0550521; EP0636763; EP0773345; EP1076245; EP1193368; EP1320659; EP1882811; WO96/024751; WO92/06275; WO05/05724; WO02/27139; WO01/3 9412; WO00/77345; WO07/095111.

The tubing string 40 can be constructed of a plurality of tubing sections that are connected together using threaded connections at both ends of the tubing sections. The tubing sections can have uniform or non-uniform pipe lengths. With respect to the non-uniform lengths, this may be caused by the tubing sections being repaired by cutting part of the connection to re-machine the threads. The uniformity or non-uniformity of the tubing lengths can affect the way in which acoustic messages propagate along the tubing string 40.

An acoustic telemetry system is a 2-way wireless communication system between downhole and surface, using acoustic wave propagation along steel pipes and the bottom hole assembly ("BHA"). One modulation scheme used in the acoustic telemetry system uses a single carrier frequency with a phase modulation (QPSK). The carrier frequency may be between 1 and 5 kHz. The frequency width of such modulation is rather narrow, ranging from ~10 Hz at low bit rate to ~50 Hz at high bit rate.

In offshore operations multiple acoustic repeaters are positioned on the tubing string 40 positioned within the subsea well 16. A last acoustic repeater is positioned on the tubing string 40 above the sea bed, and connected to surface through an electric cable. This last acoustic repeater is subjected to noise coming from above: The tubing string 40 and the riser 36 are flexible and subjected to currents, thus generating impact or friction noise. Such noise propagates down along the tubing string 40 and may overwhelm the signal coming from downhole and attenuated by the propagation through the equipment of the subsea tree 12.

One possible solution to this problem, presently used by competition, is to position the last acoustic repeater within the subsea tree 12, above the latch 26 and below the retainer valve 27. This reduces to some extent the noise level since the noise has to propagate through heavy pieces of equipment located above such as the retainer valve 27. However, space is at a premium inside the subsea tree 12 which implies an expensive mechanical redesign of the last acoustic repeater. In addition, the filtering effect of the retainer valve 27 is not optimum: assuming the retainer valve 27 can be modeled as a piece of pipe with a larger diameter (13") and a length of 1 m, connected to the 5" diameter pipe, the frequency dependent acoustic attenuation is at most 15 dB.

It is desirable to have a subsea installation in which the last acoustic repeater is positioned on the tubing string above the subsea tree while avoiding the noise within the tubing string and coming from above the last acoustic repeater. It is to such an improved subsea installation that the present disclosure is directed.

SUMMARY

This summary is provided to introduce a selection of concepts that are described below in the detailed description. This summary is not intended to identify key or essential features of the claimed subject matter, nor is it intended to be used as an aid in limiting the scope of the claimed subject matter.

In one aspect, the present disclosure describes a subsea installation kit. The subsea installation kit is provided with a subsea tree, a plurality of tubing sections, a plurality of acoustic repeaters and a mechanical filter. The subsea tree is configured to be coupled to a subsea well having a wellbore. The plurality of tubing sections are configured to be connected together to form a tubing string extending from above the subsea tree into the wellbore. The acoustic repeaters are configured to be attached to the tubing string in a spaced apart manner, with one of the acoustic repeaters being a last acoustic repeater. The last acoustic repeater is configured to be attached to the tubing string within the subsea tree. The mechanical filter is configured to be connected into the tubing string and to form a part of the tubing string above the last acoustic repeater. The mechanical filter is designed to cause an attenuation to acoustic signals propagating in the tubing string above the subsea tree.

In another aspect, the present disclosure describes a method for forming a communication system for a subsea installation. The method is performed by coupling a last acoustic repeater to a tubing section of a tubing string positioned within a subsea tree, connecting a cable to the last acoustic repeater for wired communication between the last acoustic repeater and a communication device at a surface location, and coupling a mechanical filter into the tubing string after the last acoustic repeater has been coupled to the tubing section. The mechanical filter is coupled to the tubing section between the last acoustic repeater and the communication device at the surface location and causes an attenuation to acoustic signals propagating in the tubing string.

In another aspect, the present disclosure describes a subsea installation. The subsea installation is provided with a subsea tree, a plurality of tubing sections, a plurality of acoustic repeaters and a mechanical filter. The subsea tree is coupled to a subsea well having a wellbore. The plurality of tubing sections are connected together to form a tubing string extending from above the subsea tree into the wellbore. The acoustic repeaters are attached to the tubing string in a spaced apart manner, with one of the acoustic repeaters being a last acoustic repeater attached to the tubing string within the subsea tree. The mechanical filter is connected into a tubing string and forms a part of the tubing string above the last acoustic repeater, the mechanical filter causing an attenuation to acoustic signals propagating in the tubing string above the subsea tree. In the subsea installation the first length may be equal to the second length, or the first length may be different from the second length.

BRIEF DESCRIPTION OF THE DRAWINGS

Certain embodiments of the present disclosure will hereafter be described with reference to the accompanying drawings, wherein like reference numerals denote like elements, and.

DETAILED DESCRIPTION

At the outset, it should be noted that in the development of any such actual embodiment, numerous implementation-specific decisions will be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In the summary and this detailed description, each numerical value should be read once as modified by the term "about" (unless already expressly so modified), and then read again as not so modified unless otherwise indicated in context. Also, in the summary and this detailed description, it should be understood that a concentration range listed or described as being useful, suitable, or the like, is intended to include any concentration within the range, including the end points, is to be considered as having been stated. For example, "a range of from 1 to 10" is to be read as indicating each possible number along the continuum between about 1 and about 10. Thus, even if specific data points within the range, or even no data points within the range, are explicitly identified or refer to a few specific, it is to be understood that the inventors appreciate and understand that any data points within the range are to be considered to have been specified, and that inventors possessed knowledge of the entire range and the points within the range.

The statements made herein merely provide information related to the present disclosure, and may describe some embodiments illustrating the disclosure. In the following description, numerous details are set forth to provide an understanding of the present disclosure. However, it will be understood by those of ordinary skill in the art that the embodiments of the present disclosure may be practiced without these details and that numerous variations or modifications from the described embodiments may be possible.

During offshore DST operations with an acoustic telemetry system, a last acoustic repeater is located above the sea bed and is affected by noise coming from above. It is proposed to reduce this noise level by mounting the last acoustic repeater to a tubing section within a tubing string above the subsea tree, and inserting a mechanical filter above the last acoustic repeater in the tubing string. This allows for locating the last acoustic repeater above the subsea tree, without redesigning the last acoustic repeater and with at least similar performances in signal to noise ratio.

Figure 1:
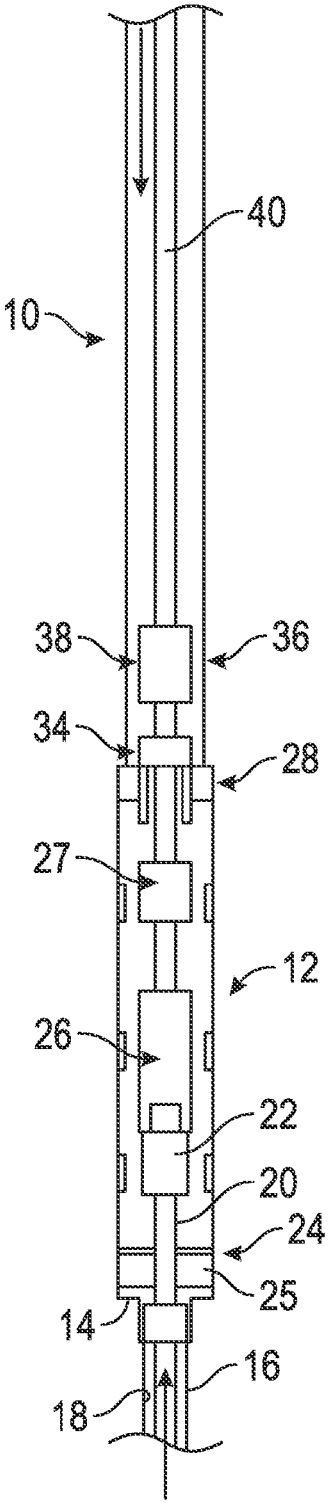
FIG. 1 is a schematic front elevation view of a prior art subsea installation.
Figure 2:
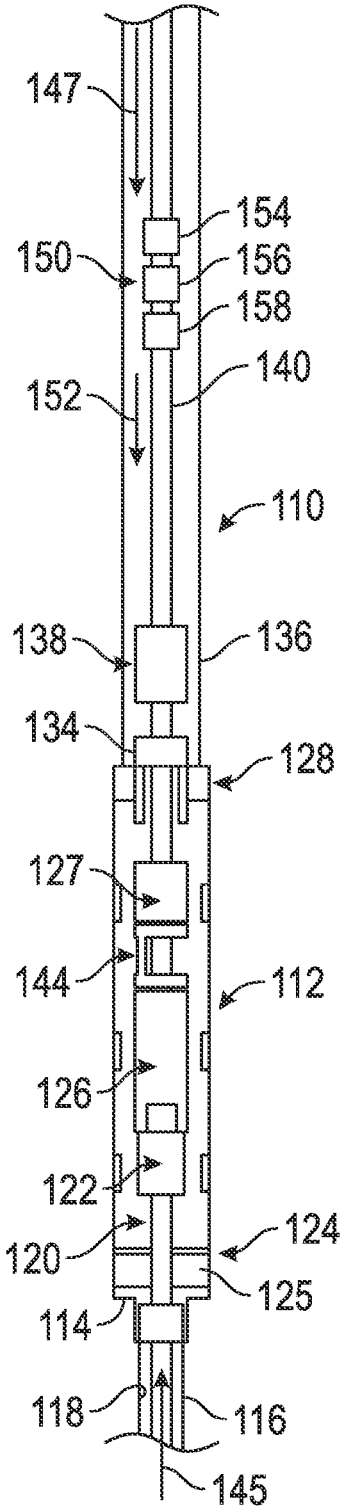
FIG. 2 is a schematic front elevational view of a subsea installation, according to an embodiment of the present disclosure.

Referring generally to FIG. 2, a subsea installation 110 is illustrated according to an embodiment of the present disclosure. The subsea installation 110 comprises a subsea tree 112 formed of a subsea wellhead 114, which may include a Christmas tree, coupled to a subsea well 116 having a wellbore 118. The illustrated subsea tree 112 further comprises a subsea lubricator 120 and a lubricating valve 122 that may be deployed directly above subsea wellhead 114. The lubricating valve 122 can be used to close the wellbore 118 during certain intervention operations, such as tool change outs. The subsea tree 112 also includes a blowout preventer 124 positioned below the lubricating valve 122 and may comprise one or more cut-and-seal rams 125 able to seal off the subsea wellhead 114 during an emergency disconnect. The subsea tree 112 also may comprise a latch 126, a retaining valve 127 and a second blowout preventer 128 positioned above the blowout preventer 124 and a spanner 134 positioned above the second blowout preventer 128. The subsea installation 110 also includes (1) a riser 136 extending from the second blowout preventer 128 to the surface, (2) a hydraulic pod 138 positioned inside the riser 136 above the spanner 134, and (3) a tubing string 140 positioned inside the riser 136. Depending on the type of subsea installation 110, the configuration and/or components of the subsea tree 112 may be varied.

The subsea installation 110 is also provided with a plurality of acoustic repeaters (not shown) configured to be attached to the tubing string 140 in a spaced apart manner, one of the acoustic repeaters being a last acoustic repeater 144 attached to the tubing string 140 above the subsea tree 112 (not shown). In another embodiment, as shown in FIG. 2, the last acoustic repeater 144 may also be located inside the subsea tree 112. The last acoustic repeater 144 receives acoustic messages 145 from one or more of the acoustic repeaters (not shown) positioned within the wellbore 118 and on the tubing string 140. The last acoustic repeater 144 is connected to a cable 146 (not shown) extending through the riser 136 to the surface for establishing bi-directional wired communication between the last acoustic repeater 144 and at least one communication device (not shown) at a surface location, such as on a ship or a platform.

Figure 3:
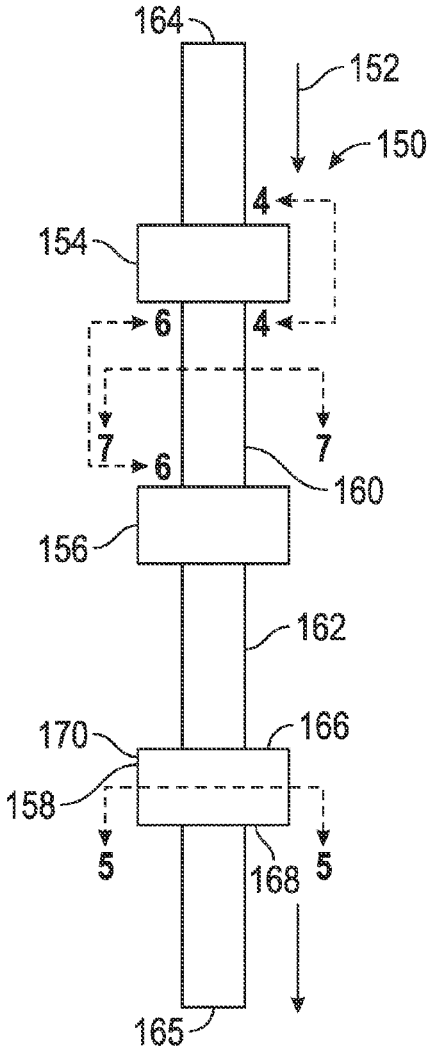
FIG. 3 is a front elevation view of a mechanical filter, according to an embodiment of the present disclosure.

To reduce the adverse effects of noise 147 generated from above the subsea tree 112 from interfering with the receipt of the acoustic messages 145 by the last acoustic repeater 144, the subsea installation 110 is provided with a mechanical filter 150 connected into the tubing string 140 and forming a part of the tubing string 140 above the last acoustic repeater 144. In one embodiment, the mechanical filter 150 is configured to cause an attenuation of at least 15 dB to acoustic signals propagating in the tubing string 140 above the subsea tree 112, as indicated in FIG. 3 by way of the arrow 152. However, it will be understood by one skilled in the art that the attenuation effect varies with the complexity of the mechanical filter 150 which may be provided in series to increase the attenuation effect, as will be described below.

The mechanical filter 150 may be installed as close as possible above the last acoustic repeater 144, so that a minimum of noise can be generated between the mechanical filter 150 and the last acoustic repeater 144. However there can be several tools in the tubing string 140 (junk basket, safety devices and their control systems) or the last acoustic repeater 144 may be located within the subsea tree 112, so the mechanical filter 150 may be located 2-10 m above the last acoustic repeater 144.

Figure 4:
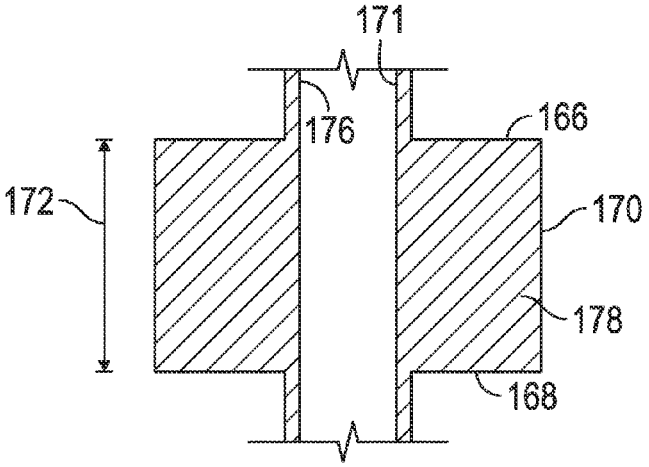
FIG. 4 is a cross-sectional view of a filter section, according to an embodiment of the present disclosure taken along the lines 4-4 in FIG. 3.
Figure 5:
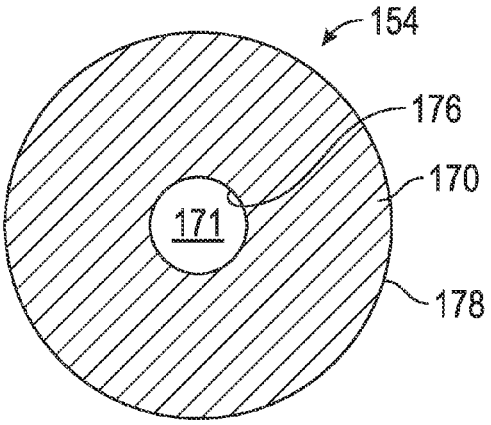
FIG. 5 is a cross-sectional view of a filter section, according to an embodiment of the present disclosure taken along the lines 5-5 in FIG. 3.

Referring now to FIGS. 3, 4, and 5, shown therein is one embodiment of the mechanical filter 150. The mechanical filter 150 is provided with a plurality of filter sections 154, 156 and 158 that may be identical in function. The mechanical filter 150 may be constructed from a single piece of material, for example, machined from a single piece of steel pipe suitable for use in the downhole environment. The mechanical filter 150, constructed from a single piece of material, may be provided with sections alternating between larger diameter filter sections and smaller diameter tubing sections, whereby the filter sections 154, 156 and 158 are spaced a distance apart by the intervening tubing sections. In the embodiment depicted in FIG. 3, the filter section 154 and the filter section 156 are separated by a tubing section 160; and the filter section 156 and the filter section 158 are separated by a tubing section 162. In one embodiment, the tubing section 160 is between the filter section 154 and the filter section 156. The plurality of filter sections 154, 156 and 158 may be disposed between a first end 164 and a second end 165 of the mechanical filter 150. The first end 164 and the second end 165 of the mechanical filter 150 may be threaded in order to be connected into the tubing string 140. It will be understood by one skilled in the art that although the mechanical filter 150 is shown in FIG. 3 with three filter sections 154, 156 and 158, the mechanical filter 150 may be provided with greater or fewer filter sections. As such, in one contemplated embodiment, the mechanical filter 150 is provided with a single filter section and in another embodiment, the mechanical filter 150 is provided with more than three filter sections.

Shown in FIG. 4 is a cross-sectional diagram of the filter section 154. The filter section 154 has a first end 166, a second end 168 and a sidewall 170 extending from the first end 166 to the second end 168 defining a bore 171 which extends from the first end 164 to the second end 165 of the mechanical filter 150. The filter section 154 is also provided with a first length 172 extending from the first end 166 to the second end 168. As shown in FIG. 5, the filter section 154 is also provided with an internal perimeter 176 defining the bore 171, and an external perimeter 178. In one embodiment, the internal perimeter 176 and the external parameter 178 are circular.

The sidewall 170 is also provided with a first cross-sectional area normal to the first length 172. The first cross-sectional area is defined by the sidewall 170 in between the internal perimeter 176 and the external perimeter 178.

The mechanical filter 150 may be designed like any other part of the tubing string 140, with threaded extremities. Its body is configured to withstand the same mechanical characteristics (pressure, tensile rating) as other equipment in the tubing string 140. These connections can be compatible with the connections of other equipment (Hydraulic pod for example) and tubing, so the mechanical filter 150 can be screwed directly on the equipment in the tubing string 140 or between two sections of the tubing string 140.

Figure 6:
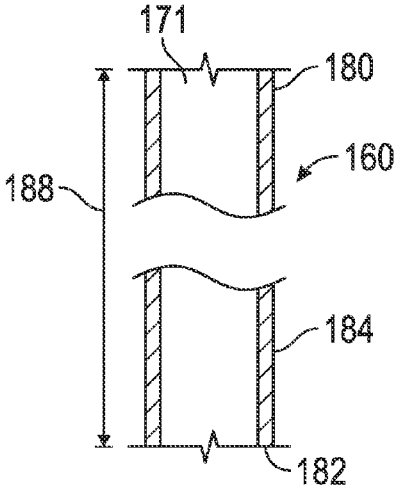
FIG. 6 is a cross-sectional view of a tubing section, according to an embodiment of the present disclosure taken along the lines 6-6 in FIG. 3.
Figure 7:
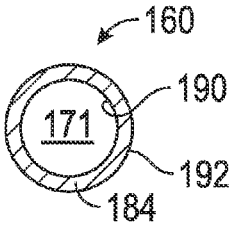
FIG. 7 is a cross-sectional view of a tubing section, according to an embodiment of the present disclosure taken along the lines 7-7 in FIG. 3.

Shown in FIG. 6 is a cross-sectional diagram of the tubing section 160. The tubing section 160 has a first end 180, a second end 182 and a sidewall 184 extending from the first end 180 to the second end 182 defining the bore 171 which also extends through the tubing section 160 between the first end 164 and the second end 165 of the mechanical filter 150. The tubing section 160 is also provided with a second length 188 extending from the first end 180 to the second end 182. An average length of the second length 188 may be more than the first length 172. As shown in FIG. 7, the tubing section 160 is also provided with an internal perimeter 190 defining the bore 171, and an external perimeter 192. In one embodiment, the internal perimeter 190 and the external perimeter 192 are circular.

The sidewall 184 is also provided with a second cross-sectional area normal to the second length 188. The second cross-sectional area is defined by the sidewall 184 in between the internal perimeter 190 and the external perimeter 192.

In another embodiment, the filter sections 154, 156 and 158 are connected to the tubing sections 160 and 162 via a threading on the first end and the second end of the filter sections 154, 156 and 158 and a threading section on the first end and the second end of the tubing sections 160 and 162. For example, the first end 166 of the filter section 154 can be externally threaded and the second end 168 of the filter section 154 can be internally threaded. In a similar manner, the first end 180 of the tubing section 160 can be externally threaded to mate with the second end 168 of the filter section 154, while the second end 182 of the tubing section 160 can be internally threaded to mate with the first end 166 of the tubing section 160.

In general, the mechanical filter 150 is implemented by providing at least one larger diameter pipe section (filter sections 154, 156 and 158) along with at least one intervening smaller diameter pipe section (tubing sections 160 and 162) within the tubing string 140 above the last acoustic repeater 144. A frequency of maximum attenuation is reached when a half wavelength of the acoustic wave of the acoustic messages 145 is equal to the sum of the first length 172 and the second length 188. The frequency may be referred to as the normalized frequency and may be adjusted to match an operating frequency $F_0$ of the telemetry system. A sum L of the first and second lengths 172 and 188, which may be indicative of a period of the mechanical filter 150, may be equal to half of an acoustic wavelength $\lambda$, for the acoustic wave, in the material composing the mechanical filter 150 at the frequency $F_0$. Knowing a velocity V, for the acoustic wave traveling through the material composing the mechanical filter 150, allows for computing L according to an Equation 1: $L=\lambda/2=V/(2F_0)$. A maximum attenuation and a bandwidth of the mechanical filter 150 are mostly controlled by a cross-section ratio of the (second cross-sectional area of the tubing section 160)/(first cross-sectional area of the filter section 154) and a number of filter sections, which in the case of the mechanical filter 150 is three. The attenuation and bandwidth of the mechanical filter 150 may also be controlled by an outer diameter ratio of the (second outer diameter of the tubing section 160)/(first outer diameter of the filter section 154).

Figure 8:
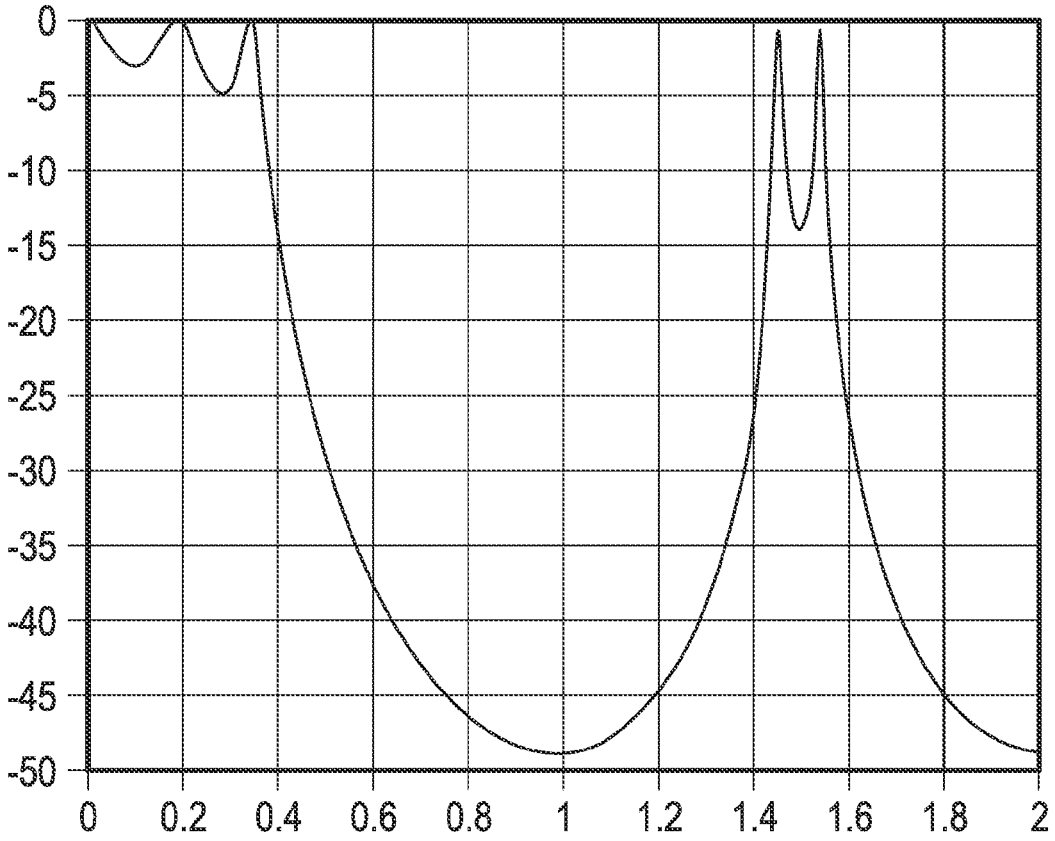
FIG. 8 is a graph illustrating attenuation of a noise level versus normalized frequency for the mechanical filter depicted in FIG. 3.

Referring to the cross-section ratio, for example, the geometry described in FIG. 3 with three filter sections 154, 156 and 158, a lengths ratio of 2.0, and a cross-section ratio of 0.10, results in the attenuation versus normalized frequency depicted in FIG. 8 with a maximum attenuation close to 50 dB and a filter width at −30 dB of 0.5 to 1.4 the frequency of maximum attenuation. In FIG. 8, the attenuation in dB is plotted along the Y axis and the normalized frequency is plotted along the X axis. FIG. 8 data points were created with three filter sections with lengths ratio of 2.00 and sections ration of 0.10.In this frequency band, the mechanical filter 150 allows for recovering at least the same signal-to-noise ratio as the last acoustic repeater 144 positioned within the subsea tree 112. At the normalized frequency of 1.0, the mechanical filter 150 provides a better signal-to-noise ratio by approximately 15 dB. The normalized frequency may be determined by Equation 1, as described above.

Figure 9:
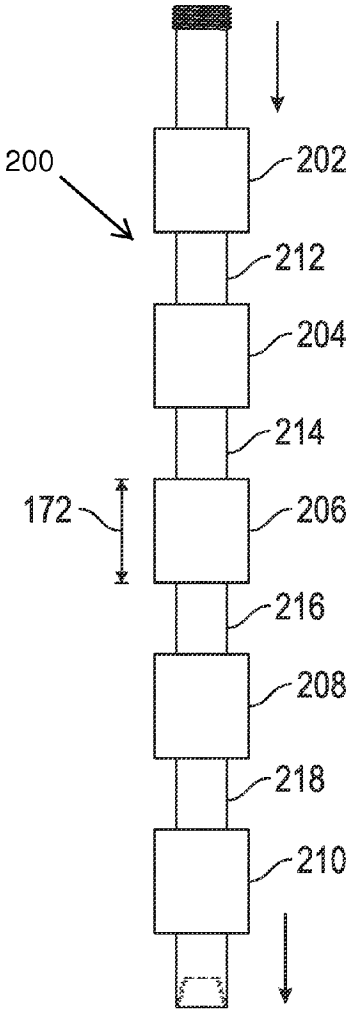
FIG. 9 is a front elevational view of another embodiment of a mechanical filter described within the present disclosure.

It should be understood that the mechanical filter 150 described herein can be implemented in a variety of manners. For example, shown in FIG. 9 is another example of a mechanical filter 200 constructed in accordance with the present disclosure. The mechanical filter 200 is constructed in an identical fashion as the mechanical filter 150 with the exception that the mechanical filter 200 is provided with five filter sections 202, 204, 206, 208 and 210 that are separated by four tubing sections 212, 214, 216 and 218. The filter sections 202-210 are constructed in a similar manner as the filter sections 154, 156, and 158 described above with the exception that the first cross-sectional area (as defined above) is reduced, and the first length 172 is increased. In the example depicted in FIG. 9 the cross-section ratio is increased to 0.29 and the lengths ratio is reduced to 0.71.

Figure 10:
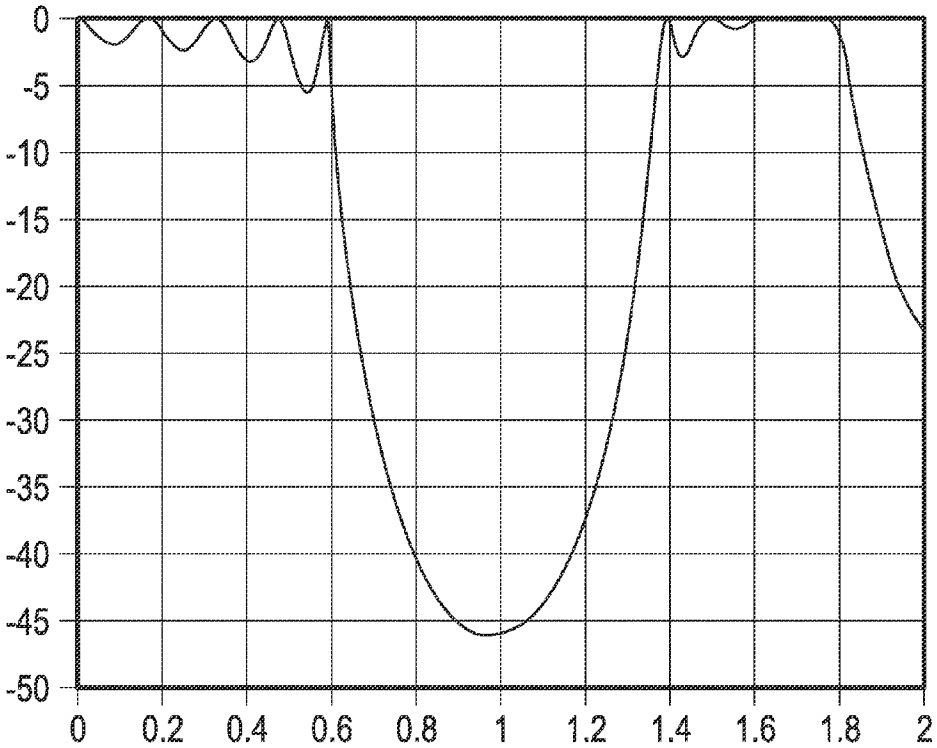
FIG. 10 is a graph illustrating attenuation of a noise level versus normalized frequency for the mechanical filter depicted in FIG. 9.

The geometry described in FIG. 9 with five filter sections 202-210, a lengths ratio of 0.71, and a cross-section ratio of 0.29, results in the attenuation versus normalized frequency depicted in FIG. 10 where the attenuation in dB is plotted along the Y axis and the normalized frequency is plotted along the X axis. This gives approximately the same maximum attenuation close to 50 dB, with a slightly reduced bandwidth of 0.7 to 1.3 the frequency of maximum attenuation. The reduced contrast in cross-section means that the mechanical filter 200 can be more easily machined, for example from a drill collar.

Of course, other mechanical filter designs could be implemented. The mechanical filters 150 and 200 described herein are provided with identical lengths 172 and 188 and cross-sectional areas to create a perfect periodicity. A perfect periodicity creates a mechanical filter with a U-shaped response curve (illustrated by FIGS. 8 and 10). A bottom of the U-shaped response curve is located at a design frequency of the mechanical filter. However, the first lengths 172 of the filter sections 154, 156, 158, and 202-212 do not have to be identical to create the mechanical filters 150 and 200 as described herein nor do the cross-sectional areas of the filter sections 154, 156, 158, and 202-212 have to be identical. Likewise, the second lengths 188 and cross-sectional areas of the tubing sections do not have to be identical to create the mechanical filters 150 and 200 as described herein. Differences in the cross-sectional areas and lengths creates a random periodicity that may decrease the efficiency (the height of the U) but increase the bandwidth (width of the U), and may allow acoustic transmissions in a wider range of frequencies.

The attenuation varies with the complexity of the mechanical filters 150 and 200. If more filter sections are provided in the mechanical filters 150 and 200, the attenuation will be higher, but the cost may also be higher. The mechanical filters 150 and 200 may be designed to be modular using two or more filter sections in series where each filter section may be separated by one of the tubing sections. In one embodiment, where the mechanical filters 150 and 200 are not constructed from a single piece of material, the modularity of the mechanical filters 150 and 200 may be exploited by adding or removing filter sections based on conditions at the wellbore 118. Depending upon the performance desired and the noise level for a given well, one filter section could be sufficient, or 3, 4, 5, or 6 filter sections may be recommended and implemented with the subsea installation 110.

The material forming the filter sections can be the same material used to form the tubing sections, i.e., a steel, that is compatible with the well effluent (that may contain $H_2S$, $CO_2$ or other components). This material may comply with standards of recommended practices of the oil business, such as NACE MR 01-75 for H2S effluents.

It should also be understood that the subsea tree 112, the plurality of tubing sections 160 and 162 (for example), the plurality of acoustic repeaters including the last acoustic repeater 144 and the mechanical filters 150, 200, and variations thereof can be a part of a subsea installation kit that can be transported to the subsea well 116 by way of a ship or the like. In this embodiment, the subsea tree 112 is configured to be coupled to the subsea well 116. The plurality of tubing sections 160 and 162 (for example) are configured to be connected together to form the tubing string 140. The plurality of acoustic repeaters is configured to be attached to the tubing string 140 in a spaced apart manner. In one embodiment, the last acoustic repeater 144 may be provided within the subsea tree 112 attached to the tubing string 140. In another embodiment, one of the acoustic repeaters may be configured to be attached to the tubing string 140 above the subsea tree 112 and may be the last acoustic repeater 144. The mechanical filters 150, 200 and variations described herein are configured to be connected into the tubing string 140 and form a part of the tubing string 140 above the last acoustic repeater 144.

The present disclosure also describes a method for forming a communication system for the subsea installation 110. In particular, the last acoustic repeater 144 is coupled to one of the tubing sections of the tubing string 140. The last acoustic repeater 144 may be coupled to the tubing string 140 while the tubing section is positioned within the riser 136 or the last acoustic repeater 144 may be coupled to the tubing string 140 within the subsea tree 112. The cable 146 can be connected to the last acoustic repeater 144 for bi-directional wired communication between the last acoustic repeater 144 and the at least one communication device (not shown) at a surface location. The mechanical filter 150, 200, or a variation thereof is then coupled into the tubing string 140 after the last acoustic repeater 144 has been coupled to the tubing section. In another method, the last acoustic repeater 144 is coupled to the tubing section prior to the tubing section being inserted into the tubing string 140.

The preceding description has been presented with reference to some embodiments. Persons skilled in the art and technology to which this disclosure pertains will appreciate that alterations and changes in the described structures and methods of operation can be practiced without meaningfully departing from the principle, and scope of this application. Accordingly, the foregoing description should be read as consistent with and as support for the following claims, which are to have their fullest and fairest scope.

The scope of patented subject matter is defined by the allowed claims. Moreover, the claim language is not intended to invoke paragraph six of 35 USC §112 unless the exact words "means for" are used. The claims as filed are intended to be as comprehensive as possible, and no subject matter is intentionally relinquished, dedicated or abandoned.

What is claimed is:

1. A subsea installation kit, comprising:
   - a subsea tree configured to be coupled to a subsea well having a wellbore;
   - a plurality of tubing sections configured to be connected together to form a tubing string extending from above the subsea tree into the wellbore; and
   - a plurality of acoustic repeaters configured to be attached to the tubing string in a spaced apart manner, one of the acoustic repeaters being a last acoustic repeater; and
   - a mechanical filter configured to be connected into the tubing string and form a part of the tubing string above the last acoustic repeater, the mechanical filter configured to attenuate acoustic signals propagating in the tubing string above the subsea tree, wherein the mechanical filter includes a first filter section having a first length and a first cross-sectional area normal to the first length, a second filter section having a second length and a second cross-sectional area normal to the second length, and a tubing section separating the first filter section and the second filter section, the tubing section having a third length and a third cross-sectional area normal to the third length and less than the first cross-sectional area and the second cross-sectional area, wherein the mechanical filter attenuates the acoustic signals propagating in the tubing string above the subsea tree at a desired bandwidth and amount of attenuation based on a cross-section ratio of the third cross-sectional area to the first cross-sectional area.

2. The subsea installation kit of claim 1, wherein the last acoustic repeater is configured to be attached to the tubing string above or within the subsea tree.

3. The subsea installation kit of claim 1, wherein the mechanical filter attenuates the acoustic signals propagating in the tubing string above the subsea tree by 15 dB.

4. The subsea installation kit of claim 1, wherein the first filter section and the second filter section have a first end, a second end, a sidewall extending from the first end to the second end, and the first and second lengths extending from the first end to the second end, the sidewall defining a bore extending from a first end to a second end of the mechanical filter.

5. The subsea installation kit of claim 4, wherein the first end of the first filter section and the second filter section is externally threaded, and wherein the second end of the first filter section and the second filter section is internally threaded.

6. The subsea installation kit of claim 1, wherein the first length is different from the second length.

7. The subsea installation kit of claim 1, wherein the mechanical filter is constructed from a single piece of material.

8. The subsea installation kit of claim 1, wherein the mechanical filter is modular such that multiple filter sections and tubing sections may be added to or removed from the mechanical filter in order to provide a desired attenuation and bandwidth based on conditions at the wellbore.

9. The subsea installation kit of claim 1, wherein the first cross-sectional area is different from the second cross-sectional area.

10. The subsea installation kit of claim 1, wherein the mechanical filter has more than two filters sections and one tubing section separating the filter sections, wherein the number of filter sections and tubing sections are selected to provide a desired bandwidth and amount of attenuation based on the number of filter sections and tubing sections.

11. A method for forming a communication system for a subsea installation, comprising:

coupling a last acoustic repeater to a tubing section of a tubing string positioned within a subsea tree;

connecting a cable to the last acoustic repeater for wired communication between the last acoustic repeater and a communication device at a surface location; and coupling a mechanical filter into the tubing string after the last acoustic repeater has been coupled to the tubing section, the mechanical filter coupled to the tubing section between the last acoustic repeater and the communication device at the surface location and the mechanical filter configured to attenuate acoustic signals propagating in the tubing string above the mechanical filter, wherein the mechanical filter includes a first filter section having a first length and a first cross-sectional area normal to the first length, a second filter section having a second length and a second cross-sectional area normal to the second length, and a tubing section separating the first filter section and the second filter section, the tubing section having a third length and a third cross-sectional area normal to the third length and less than the first cross-sectional area and the second cross-sectional area, wherein the mechanical filter attenuates the acoustic signals propagating in the tubing string above the mechanical filter at a desired bandwidth and amount of attenuation based on a cross-section ratio of the third cross-sectional area to the first cross-sectional area.

12. The method of claim 11, wherein the mechanical filter attenuates the acoustic signals propagating in the tubing string above the mechanical filter by 15 dB.

13. A subsea installation, comprising:

a subsea tree coupled to a subsea well having a wellbore;

a plurality of tubing sections connected together to form a tubing string extending from above the subsea tree into the wellbore;

a plurality of acoustic repeaters attached to the tubing string in a spaced apart manner, one of the acoustic repeaters being a last acoustic repeater; and a mechanical filter connected into the tubing string and forming a part of the tubing string above the last acoustic repeater, the mechanical filter attenuating acoustic signals propagating in the tubing string above the subsea tree, wherein the mechanical filter includes a first filter section having a first length and a first cross-sectional area normal to the first length, a second filter section having a second length and a second cross-sectional area normal to the second length, and a tubing section separating the first filter section and the second filter section, the tubing section having a third length and a third cross-sectional area normal to the third length and less than the first cross-sectional area and the second cross-sectional area, wherein the mechanical filter attenuates the acoustic signals propagating in the tubing string above the mechanical filter at a desired bandwidth and amount of attenuation based on a cross-section ratio of the third cross-sectional area to the first cross-sectional area.

14. The subsea installation of claim 13, wherein the last acoustic repeater is attached to the tubing string above or within the subsea tree.

15. The subsea installation of claim 13, wherein the mechanical filter attenuates the acoustic signals propagating in the tubing string above the subsea tree by 15 dB.

16. The subsea installation of claim 13, wherein the first filter section and the second filter section have a first end, a second end, a sidewall extending from the first end to the second end, and the first and second lengths extending from the first end to the second end, the sidewall defining a bore extending from the first end to the second end.

17. The subsea installation of claim 16, wherein the first end of the first filter section and the second filter section is externally threaded, and wherein the second end of the first filter section and the second filter section is internally threaded.

18. The subsea installation of claim 13, wherein the mechanical filter is modular such that multiple filter sections and tubing sections may be added to or removed from the mechanical filter in order to provide a desired attenuation and bandwidth based on conditions at the wellbore.

19. The subsea installation of claim 13, wherein the first cross-sectional area is different from the second cross-sectional area.

20. The subsea installation of claim 13, wherein the mechanical filter has more than two filters sections and one tubing section separating the filter sections, wherein the number of filter sections and tubing sections are selected to provide a desired bandwidth and amount of attenuation based on the number of filter sections and tubing sections.

* * * * *